United States Patent [19]

Barnwell et al.

[11] 3,999,558

[45] Dec. 28, 1976

[54] ORTHOPEDIC SHOE PLATE

[76] Inventors: Joseph H. Barnwell, P.O. Box 5918 Tech. Sta.; Daniel D. Reneau, Jr., Llanfair Drive, both of Ruston, La. 71270

[22] Filed: Mar. 24, 1975

[21] Appl. No.: 561,158

[52] U.S. Cl. ..... 128/586; 128/608; 128/621

[51] Int. Cl.[2] ..... A43B 7/14

[58] Field of Search ..... 128/586, 587, 588, 593, 128/608, 618, 621; 36/76

[56] References Cited

UNITED STATES PATENTS

| | | | |
|---|---|---|---|
| 811,512 | 1/1906 | Lee | 128/588 |
| 1,194,672 | 8/1916 | Scholl | 128/621 |
| 2,129,424 | 9/1938 | Jay | 128/621 X |
| 3,550,597 | 12/1970 | Coplans | 128/608 |

*Primary Examiner*—John D. Yasko
*Attorney, Agent, or Firm*—John M. Harrison

[57] ABSTRACT

An orthopedic shoe plate extending from the heel to the toe of a shoe sole and having an arch support, with a plurality of slots forward of the arch support in the toe portion of the plate. The plate permits normal foot movement but is designed to bias the heel downwardly, and exercises the muscles and tendons of the leg and foot when weight is placed on the toe region during the walking operation.

8 Claims, 3 Drawing Figures

ORTHOPEDIC SHOE PLATE

BACKGROUND OF THE INVENTION

1. Field of the Invention

This invention relates to a new and improved orthopedic shoe plate and particularly, to a new and improved orthopedic shoe plate for insertion in the shoe soles of infants and children who have physical weaknesses in the muscles of the foot and legs and particularly, in the achilles or heel tendon. Such physical infirmities are frequently manifested in an inability to walk with the normal heel-to-toe gait, the tendon and/or muscle tension being sufficiently severe to cause initial toe contact with the walking surface, thereby causing a limp. Frequently, the heel never touches the walking surface, and therapy, designed to stretch the achilles tendon, as well as surgery to lengthen the tendon are generally indicated to correct the limp. The orthopedic shoe plate of this invention may be quickly and easily inserted in functional position into substantially any shoe sole, and is designed to force the heel downward to the walking surface over a long life span without failing or loss of tension. The plate can also be produced with a built-in arch support if desired.

2. Description of the Prior Art

Heretofore, various devices have been developed in the prior art for the purpose of providing orthopedic arch supports in shoes, although no shoe plates designed for the purpose of forcing the heel into position during walking are known to applicant. Typical of the prior art devices which have been developed is that disclosed in U.S. Pat. No. 2,129,424 to S. J. Jay, entitled "Arch Support." This patent discloses an arch support developed for positioning between the inner and outer soles of a shoe or boot to support the longitudinal arch of the foot. It is significant that the arch support of this invention was designed to provide support from a point just rearward of, to a point just forward of the arch, as illustrated in FIG. 1 of the Jay drawing.

Conventional arch supports such as that illustrated in the patent to S. J. Jay are designed to do exactly what the patent title implies; that is, to support the arch area of the foot and to maintain the natural curve of the arch. Consequently, most of these supports extend from just rearward of the arch to the ball of the foot area and no further. Furthermore, these arch supports are not designed to stretch the achilles tendon or place stress on any of the muscles of the foot or leg such as the calf muscle, but purely and simply to support the base of the metatarsal arch of the foot in the proper foot curvature.

Accordingly, an object of this invention is to provide an orthopedic device for insertion in the sole of a shoe, which device is designed to place a pivot point in the toe region of the foot and force the shoe heel downwardly in the walking operation.

Another object of this invention is to provide an orthopedic device for placing the achilles tendon in tension and stretching this tendon as the user walks.

A still further object of the invention is to provide an orthopedic shoe plate for insertion in the sole of a shoe, which plate serves as a combined arch support and exerciser and developer for the muscles and tendons of the foot including the calf muscle.

Yet another object of the invention is to provide an orthopedic shoe plate for exercising the leg muscles and achilles tendon of the foot by forcing the heel of the foot downward while walking.

A still further object of the invention is to provide an orthopedic shoe plate which functions as a combined arch support and exerciser and which is fitted with a plurality of slots in the toe region to properly distribute stress throughout the plate and force the heel downwardly during the walking operation.

Another object of the invention is to provide an orthopedic shoe plate for forcing the heel of the user downwardly, thereby stretching the achilles tendon and exercising and developing the foot and leg muscles, including the calf muscle which plate consists of an arch support and slotted toe region which conforms to the shape of the foot and distributes stress during the walking operation.

SUMMARY OF THE INVENTION

These and other objects of the invention are provided in an orthopedic shoe plate which may include an arch support extending from rearwardly of the ball of the foot to the heel of the foot and which includes a toe portion formed integrally with the heel portion of the plate and having a plurality of slots therein for distributing stress from the toe to the ball area of the foot during the walking operation.

BRIEF DESCRIPTION OF THE DRAWINGS

The invention will be better understood in view of the following description presented with reference to the accompanying drawings.

DESCRIPTION OF THE PREFERRED EMBODIMENTS

Figure 1:
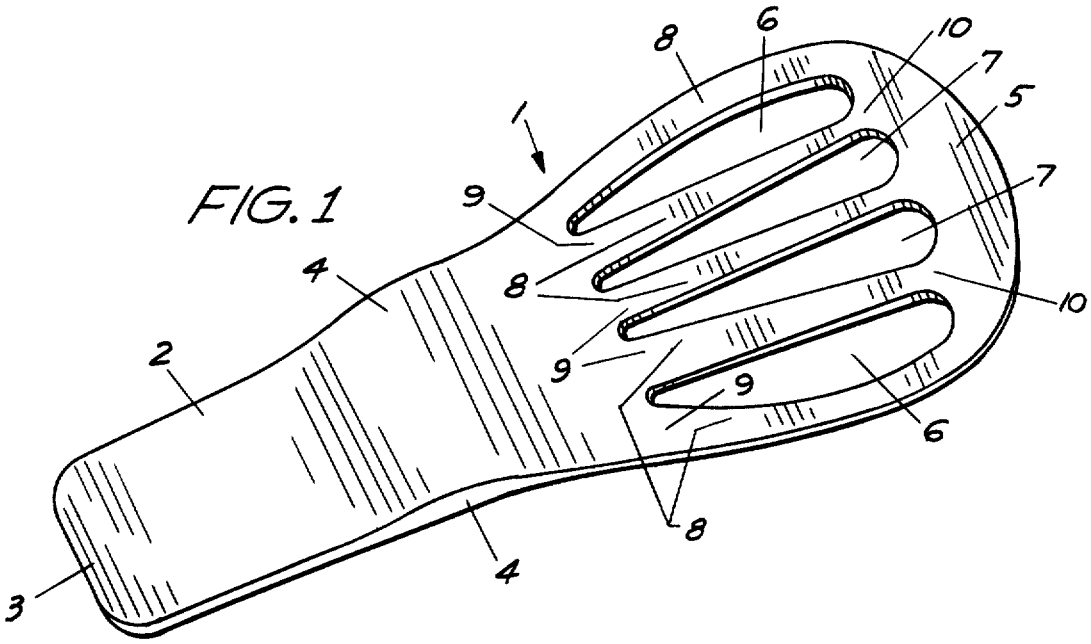
FIG. 1 of the drawings is a perspective view of the orthopedic shoe plate of this invention.

Referring now to FIG. 1 of the drawing, the orthopedic shoe plate of this invention is generally illustrated by reference numeral 1. Orthopedic shoe plate 1 consists of plate 2 with plate heel 3, optional plate arch 4, and plate toe 5. Outside slots 6 and inside slots 7 are cut in plate toe 5 to form stress ribs 8, each with a stress rib base 9 and a stress rib tip 10, in order to properly distribute the walking stress, as is hereinafter more particularly described. Orthopedic shoe plate 1 is designed to be inserted in the sole of a shoe (not illustrated) and is designed to extend from the heel across the arch to the toe of the shoe.

Plate 2 may be formed of substantially any flexible, resilient material such as high carbon steel, plastic and fiberglass; however, the material utilized must be capable of sustaining multiple flexures without failing. The thickness of plate 1, and the size and positioning of outside slots 6, inside slots 7 and thus stress ribs 8, will depend upon the particular material chosen. Plate arch 4 is designed in conventional manner to support the metatarsal arch of the foot and may be fitted into the plate of this invention or provided as a separate component of the shoe, according to the teachings of those skilled in the art.

The orthopedic shoe plate of this invention is designed to cause the heel of an individual to be forced downwardly when the toe touches the walking surface during the walking operation. As heretofore pointed out, in certain cases due to muscular and/or tendon weaknesses, some individuals, and children in particular, have a tendency to walk by making initial toe contact instead of the normal heel contact. This tendency produces an abnormal gait or limp and is caused by a tightening of the achilles tendon of the foot which causes the foot to be positioned with the toes downward and the heel in an upward position while walking. The shoe plate of this invention extends from the extreme end of the toes rearwardly to the heel area and stress ribs 8 act jointly to bias the heel of the foot downwardly with each stride when the toe and ball of the foot initially contact the walking surface. This action causes a stretching, exercising and strengthening function in the achilles tendon, leg and foot muscles, thereby tending to lengthen the tendon and place the foot in a more normal walking configuration. Continued use of the orthopedic shoe plate provides exercise therapy for the tendon, foot and leg muscles, and particularly the calf muscle, and also frequently functions to allow the user to walk properly with the heel of the foot initially striking the walking surface.

Accordingly, the orthopedic shoe plate of this invention serves several useful functions, first, it provides a conventional arch support in a desired configuration; secondly, it exercises and stretches the achilles tendon of the foot in a corrective fashion and aides the user in walking with a normal gait; and third, it exercises and strengthens the muscles of the leg and foot and the calf muscle, particularly.

Figure 2:
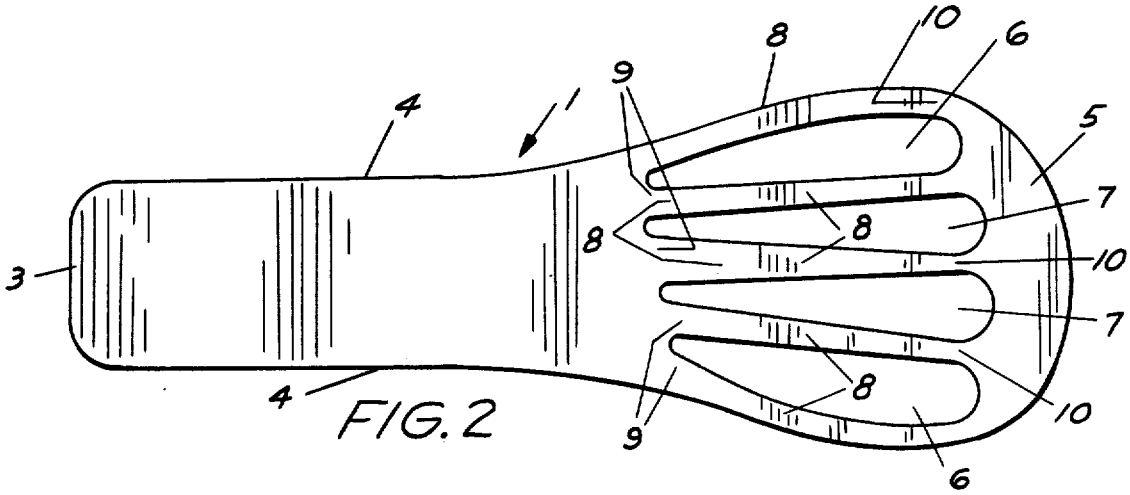
FIG. 2 is a top elevation of the orthopedic shoe plate illustrated in FIG. 1.
Figure 3:
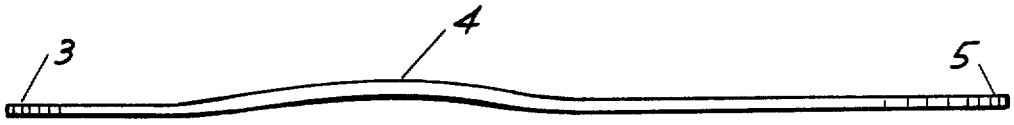
FIG. 3 is a side elevation of the shoe plate illustrated in FIGS. 1 and 2.

It is significant that orthopedic shoe plate 1 illustrated in FIGS. 1–3 of the drawing is not solid throughout its length, but is equipped with outside slots 6, inside slots 7 and stress ribs 8 to properly distribute the stress realized from the weight of the user in the walking operation. It has surprisingly been found that under circumstances where a solid plate is utilized to maintain the heel in contact with a walking surface after the toe has made such contact, two problems are frequently manifested. First, under circumstances where plate 1 is designed to be very thin and no slots are provided, stress accumulations have been found forward of plate arch 4 and rearward of plate toe 5 and stress rib base 9 of stress ribs 8, which stress results in failure of the plate after multiple flexures of plate 1. Conversely, under circumstances where plate 1 has been designed sufficiently thick to withstand the stress accumulations forward of plate arch 4, the shoe sole was found to be too rigid for normal walking. Accordingly, outside slots 6 and inside slots 7 are provided in plate toe 5 to form stress ribs 8 which act to properly distribute stress throughout plate toe 5 and forward of plate arch 4 in order to maximize the number of flexures which plate 1 can realize without failure. While the particular configuration, length and width of outside slots 6 and inside slots 7 and hence, stress ribs 8, may be varied depending upon the weight of the individual and particular stress distribution desired, it is generally preferable that stress ribs 8 be wider at the stress rib base 9 than at stress rib tip 10 in order to distribute the stress produced by the weight of the foot from front to rear in an increasing bias as the weight is increasingly placed on the foot while walking. Stress ribs 8 therefore act as stress distributors when weight is placed on the foot to force the heel downwardly in a smooth, continuous, natural motion rather than in an abrupt and rapid action. Plate toe 5 serves to connect stress ribs 8 at stress rib tips 10 and to insure that the stress ribs act in concert to effect the desired continued and increasing bias on the heel tendon and foot and leg muscles as weight is placed on the toe while the walking operation commences.

It will be appreciated that the orthopedic shoe plate of this invention may be inserted in the sole of substantially all conventional and corrective shoes and, as heretofore noted, may be manufactured with or without an arch support, as desired. The plate may be quickly and easily inserted in new shoes during the manufacturing operation and is designed to last at least through the life of the shoe.

Having described my invention with the particularity set forth above what is claimed is:

1. An orthopedic shoe plate comprising an essentially flat, flexible plate having a toe region and a heel region and a plurality of slots and a plurality of stress ribs in said toe region to distribute stress through said toe region and force said heel region downward during walking, said stress ribs each being tapered from the base to the tip thereof.

2. The orthopedic shoe plate of claim 1 wherein said plurality of slots is four slots and said plurality of stress ribs is five stress ribs.

3. The orthopedic shoe plate of claim 1 further including an arch support.

4. The orthopedic shoe plate of claim 1 wherein said flexible plate is shaped substantially in the form of a shoe sole, said plurality of slots is four slots, and said plurality of stress ribs is five stress ribs, and further including an arch support.

5. The orthopedic shoe plate of claim 1 wherein said flexible plate is spring steel.

6. The orthopedic shoe plate of claim 1 wherein:

a. said plurality of slots is four slots and said plurality of stress ribs is five stress ribs; and b. said flexible plate is spring steel.

7. The orthopedic shoe plate of claim 1 wherein:

a. said flexible plate is shaped in the form of a shoe sole;

b. said plurality of slots is four slots and said plurality of stress ribs is five stress ribs and c. said flexible plate is spring steel.

8. The orthopedic shoe plate of claim 1 wherein said plurality of slots is four slots, said plurality of stress ribs is five stress ribs, said flexible plate is spring steel and further including an arch support.

* * * * *